US009546791B2

(12) United States Patent
Baek et al.

(10) Patent No.: US 9,546,791 B2
(45) Date of Patent: Jan. 17, 2017

(54) COOKING APPLIANCE

(71) Applicant: LG ELECTRONICS INC., Seoul (KR)

(72) Inventors: Seungjo Baek, Seoul (KR); Seongho Cho, Seoul (KR); Dongseong Kwag, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 656 days.

(21) Appl. No.: 13/914,940

(22) Filed: Jun. 11, 2013

(65) Prior Publication Data

US 2013/0327309 A1 Dec. 12, 2013

(30) Foreign Application Priority Data

Jun. 12, 2012 (KR) ..... 10-2012-0062633

(51) Int. Cl.
*F24C 15/00* (2006.01)
*F24C 15/08* (2006.01)
*F24C 15/02* (2006.01)

(52) U.S. Cl.
CPC ..... *F24C 15/00* (2013.01); *F24C 15/02* (2013.01); *F24C 15/08* (2013.01)

(58) Field of Classification Search
CPC ..... F24C 15/00; F24C 15/02; F24C 15/007
USPC ..... 126/19 R
See application file for complete search history.

(56) References Cited

U.S. PATENT DOCUMENTS 2,646,762 A * 7/1953 Ingraham ..... F24C 15/08 126/19 R
4,122,323 A * 10/1978 Staats ..... H05B 6/763 219/741
5,960,785 A * 10/1999 Byrne ..... F24C 15/004 126/190

* cited by examiner

*Primary Examiner* — Kenneth Rinehart
*Assistant Examiner* — Logan Jones
(74) *Attorney, Agent, or Firm* — Ked & Associates, LLP

(57) ABSTRACT

Provided is a cooking appliance. The cooking appliance includes a cavity assembly having a cooking chamber and a door that selectively opens or closes the cooking chamber. The cavity assembly includes a cavity including a plurality of plates defining a top surface, a bottom surface, and both side surfaces of the cooking chamber, wherein a first flange part is disposed on each of front end of the plurality of plates, and a front plate having an entrance opening through which food enters into the cooking chamber, the front plate including a second flange part. The first flange part and the second flange part line-contact each other.

16 Claims, 8 Drawing Sheets

COOKING APPLIANCE

CROSS-REFERENCE TO RELATED APPLICATIONS

The present application claims priority under 35 U.S.C. 119 and 35 U.S.C. 365 to Korean Patent Application No. 10-2012-0062633 (filed on Jun. 12, 2012), which is hereby incorporated by reference in its entirety.

BACKGROUND

The present disclosure relates to a cooking appliance.

Cooking appliances are home appliances that heat and cook food to be cooked (hereinafter, referred to as food). Such a cooking appliance includes a cavity assembly defining a cooking chamber in which food is cooked.

FIG. 1 is a perspective view of a cavity assembly according to a related art, FIG. 2 is a cross-sectional view illustrating a main part of the cavity assembly according to the related art, and FIG. 3 is a perspective view of a door according to the related art.

Referring to FIG. 1, a cavity assembly 10 includes a cooking chamber 11 therein. The cavity assembly 10 includes a cavity 110 and a front plate 200.

In detail, the cavity 100 has an approximately polyhedral shape with an opened front side. The cavity 100 includes an upper plate 110, a bottom plate 120, a pair of side plates 130, and a rear plate 140. The upper plate 110, the bottom plate 120, the pair of side plates 130, and the rear plate 140 define a top surface, a bottom surface, both side surfaces, and a rear surface of the cavity 100, respectively. Thus, the upper plate 110, the bottom plate 120, the pair of side plates 130, and the rear plate 140 may substantially define a top surface, a bottom surface, both side surfaces, and a back surface of the cooking chamber 11, respectively.

Also, the front plate 200 has a plate shape with a predetermined area. An entrance opening 201 is defined in the front plate 200. The entrance opening 201 is defined by cutting a portion of the front plate 200. Substantially, the entrance opening 201 may have a shape and size corresponding to those of the cavity 100.

The cavity 100 and the front plate 200 are welded and fixed to each other in a state where a front end of the cavity 100 contacts a back surface of the front plate 200.

Referring to FIG. 2, first flange parts 111, 121, 131, and 141 are disposed on the front end—substantially, front ends of the upper plate 110, the bottom plate 120, and the pair of side plates 130—of the cavity 100. Also, a second flange part 211 is disposed on an inner edge—substantially, an edge of the entrance opening 201—of the front plate 200.

The first flange parts 111, 121, 131, and 141 are bent in an approximately rectangular shape from the front ends of the upper plate 110, the bottom plate 120, and the pair of side plates 130 to extend in upper, lower, and both side directions, respectively. The second flange part 211 includes a first portion 213 bent approximately perpendicularly from the edge of the entrance opening 201, a second portion 215 bent approximately perpendicularly from a front end of the first portion 213 to extend parallel to the front plate 200, and a third portion 217 bent approximately perpendicularly from a front end of the second portion 215 to extend parallel to the first portion 213.

The front end of cavity 100 and the second flange part 211 is welded and fixed to each other in a state where the front end of the cavity 100 including the first flange parts 111, 121, 131, and 141 and a portion of the second flange part 211 contact each other.

Substantially, a front surface of the second portion 215 contacts rear surfaces of the first flange parts 111, 121, 131, and 141, and an outer surface of the front end of the cavity 100 contacts an inner surface of the third portion 217.

Referring to FIG. 3, a door for opening or closing the cooking chamber 1 includes a door panel 300, a font glass (not shown), a door frame 400, and a rear glass 500. The door panel 300 and the door frame 400 define front and back surfaces of the door 30, respectively. A front opening (not shown) and a rear opening 401 are defined in the door panel 300 and the door frame 400, respectively. Also, the front glass and the rear glass 500 are disposed on the front opening and the rear opening 401, respectively.

In a state where the door 30 covers the cooking chamber 11, an edge of a back surface of the door 30, substantially, an edge of a back surface of the door frame 400 contacts a front surface of the front plate 200. Also, a remaining portion of the back surface of the door frame 400 except for the edge of the back surface of the door frame 400, i.e., a central portion of the back surface of the door 30 is exposed to the inside of the cooking chamber 11. Thus, the central portion and the edge of the back surface of the door frame 400 may have a temperature difference therebetween.

However, in the cooking appliance according to the related art, heat generated while food is cooked within the cooking chamber 11 is transferred to the front plate 200 through the cavity 100. Thus, heat used for cooking the food within the cooking chamber 11 may be conducted through the cavity 100, the front plate 200, and the door frame 400 to cause heat losses.

SUMMARY

Embodiments provide a cooking appliance.

In one embodiment, a cooking appliance includes: a cavity assembly having a cooking chamber; and a door that selectively opens or closes the cooking chamber, wherein the cavity assembly includes: a cavity including a plurality of plates defining a top surface, a bottom surface, and both side surfaces of the cooking chamber, wherein a first flange part is disposed on each of front end of the plurality of plates; and a front plate having an entrance opening through which food enters into the cooking chamber, the front plate including a second flange part, wherein the first flange part and the second flange part line-contact each other.

In another embodiment, a cooking appliance includes: a cavity assembly having a cooking chamber; and a door that selectively opens or closes the cooking chamber, wherein the door includes a door frame defining outer appearances of a back surface and a circumferential surface of the door, the door frame includes: a first frame defining an outer appearance of a portion of the back surface of the door; and a second frame disposed inside the first frame, the second frame being fixed to the first frame, and a flange part line-contacting an inner edge of the first frame is disposed on the second frame.

In further another embodiment, a cooking appliance includes: a cavity assembly having a cooking chamber; and a door that selectively opens or closes the cooking chamber, wherein the cavity assembly includes: a cavity including a plurality of plates defining a top surface, a bottom surface, and both side surfaces of the cooking chamber, wherein a first flange part is disposed on each of front end of the plurality of plates; and a front plate having an entrance opening through which food enters into the cooking chamber, the front plate including a second flange part, wherein the first flange part and the second flange part are connected to each other by a spacer disposed to cross each of the first and second flange parts.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense.

Figure 4:
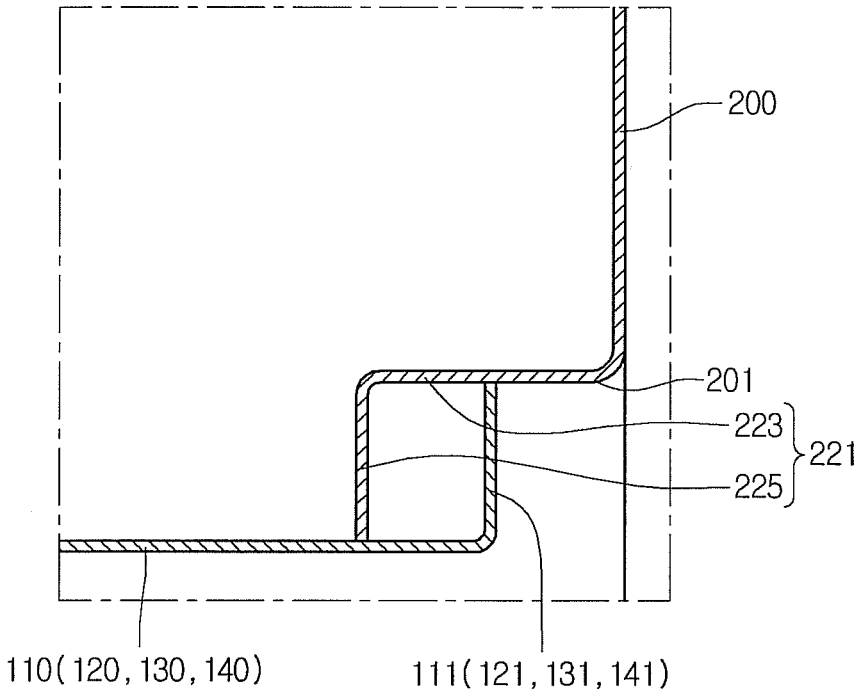
FIG. 4 is a cross-sectional view illustrating a main part of a cavity assembly of a cooking appliance according to an embodiment.
Figure 5:
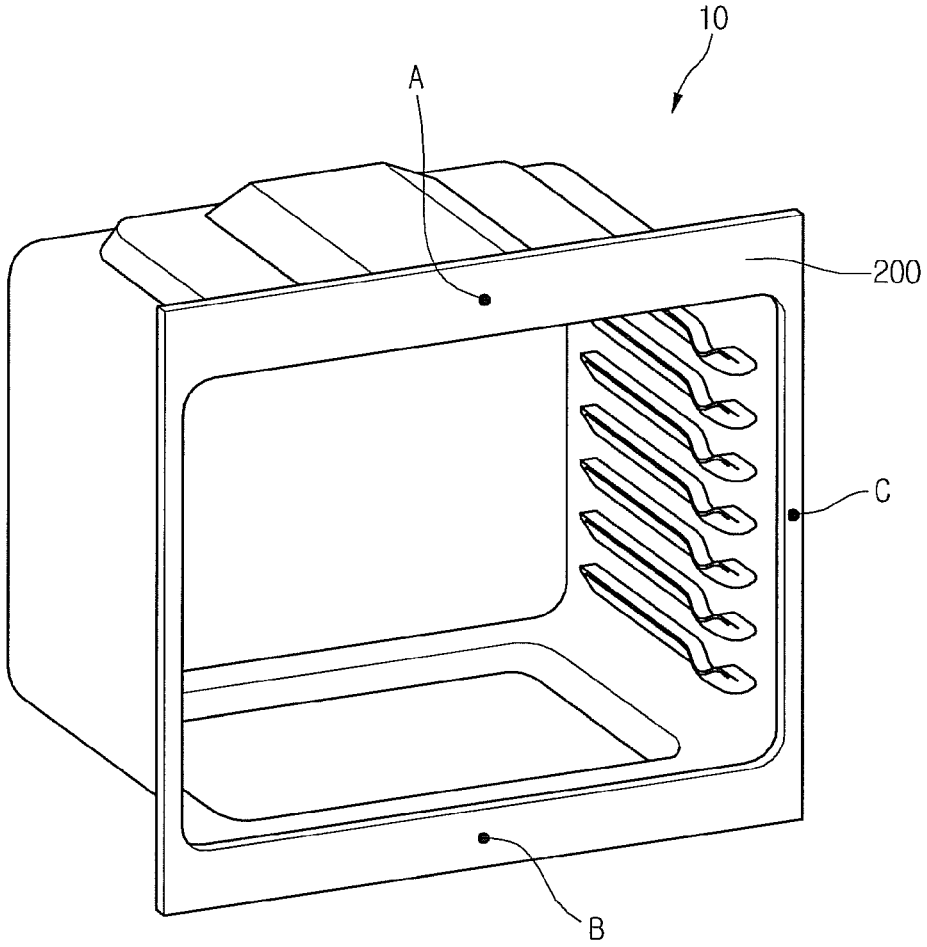
FIG. 5 is a perspective view for comparing a temperature distribution of the cavity assembly according to an embodiment to that of a cavity assembly according to the related art.

FIG. 4 is a cross-sectional view illustrating a main part of a cavity assembly of a cooking appliance according to an embodiment, and FIG. 5 is a perspective view for comparing a temperature distribution of the cavity assembly according to an embodiment to that of a cavity assembly according to the related art.

Referring to FIG. 4, a cavity assembly 10 constituting a cooking appliance according to an embodiment includes a cavity 100 and a front plate 200. The cavity 100 includes an upper plate 110, a bottom plate 120, a pair of side plates 130, and a rear plate 140. The upper plate 110, the bottom plate 120, the pair of side plates 130, and the rear plate 140 have a hexahedral shape with an opened front side on the whole to define a cooking chamber 11 therein. Also, the upper plate 110, the bottom plate 120, the pair of side plates 130, and the rear plate 140 define a top surface, a bottom surface, both side surfaces, and a rear surface of the cavity 100, respectively. The front plate 200 is fixed to a front end of the cavity 100, i.e., front ends of the upper plate 110, the bottom plate 120, the pair of side plates 130, and the rear plate 140. An entrance opening 201 through which food enters into the cooking chamber 11 is defined in the front plate 200. Since the cavity 100 and the front plate 200 are the same constitution as those according to the related art, their detailed descriptions will be omitted.

In the current embodiment, first flange parts 111, 121, 131, and 141 are disposed on the front ends of the upper plate 110, the bottom plate 120, and the pair of side plates 130, respectively. Substantially, since the first flange parts 111, 121, 131, and 141 respectively disposed on the front ends of the upper plate 110, the bottom plate 120, and the pair of side plates 130 have the same function, only the first flange part 111 disposed on the upper plate 110 will be described below.

The first flange part 121 is bent perpendicularly from the front end of the upper plate 110. Here, the first flange part 111 is disposed on an overall length of the front end of the upper plate 110.

Also, a second flange part 221 is disposed on an inner edge of the front plate 200, i.e., an edge of the entrance opening 201. The second flange part 221 includes an extension part 223 and a support part 225. The extension part 223 is bent approximately perpendicular to the front plate 200 from the inner edge of the entrance opening 201. Thus, the extension part 223 extends parallel to the upper plate 110. Here, a front end of the extension part 223 is spaced backward from a rear surface of the first flange part 111. Also, one extension part 223 may be provided on an overall length of the inner edge of the entrance opening 201. The support part 225 may be bent parallel to the front plate 200, i.e., approximately perpendicular to the extension part 223 from a front end of the extension part 223. Thus, the support part 225 may be perpendicular to the upper plate 110 and parallel to the first flange part 111. One support member 225 may be provided on an overall length of the front end of the extension part 223, or a plurality of support members 225 may be provided on the front end of the extension part 223 at positions spaced a preset distance from each other.

In the current embodiment, the front end of the first flange part 111 may contact the second flange part 221, substantially, an outer surface of the extension part 223, i.e., a bottom surface of the extension part 223. However, since the first flange part 111 is provided on the overall length of the front end of the upper plate 110, the first flange part 111 may line-contact the front plate 200, substantially, the second flange part 221.

Also, the front end of the support part 225, i.e., a lower end of the support part 225 contacts an outer surface of the upper plate 110, i.e., a top surface of the upper plate 110. As described above, when the support part 225 is provided on the overall length of the front end of the extension part 223, the support part 225 line-contacts the upper plate 110. That is, the second flange part 221 line-contacts the cavity 100. On the other hand, when the support part 225 is provided in plurality on the front end of the extension part 223 at positions spaced a preset distance from each other, the support part 225 may have a width relatively less than a thickness thereof. Thus, the support part 225 may point-contact the upper plate 110. That is to say, the second flange part 221 may point-contact the cavity 100.

As described above, the first flange part 111 is welded to the second flange part 221 in a state where the first and second flange parts 111 and 221 line-contact each other. Also, since the second flange part 221 line-contacts or point-contacts the cavity 100, the cavity 100 and the front plate 200 may be more firmly supported. Thus, according to the current embodiment, a contact area between the cavity 100 and the front plate 200 may be reduced when compared to a structure according to the related art.

Also, the support part 225 and the first flange part 111 are spaced a predetermined distance from each other.

Referring to FIG. 5, temperatures at points A, B, and C of the front plate 200 respectively corresponding to upper, lower, and side directions of the entrance opening 201 are measured as shown in Table 1 below. Thus, it may be seen that a temperature at each of the points of the front plate 200 adjacent to the entrance opening 201 is relatively reduced when compared to a case according to the related art. This represents that leakage of heat within the cooking chamber 11 through the front plate 200 to the outside in the case according to the current embodiment is relatively reduced when compared to the case according to the related art.

TABLE 1

| | Point A(° C.) | Point B(° C.) | Point C(° C.) |
|---|---|---|---|
| Related Art | 270 | 232 | 215 |
| Embodiment | 250 | 213 | 165 |

Figure 1:
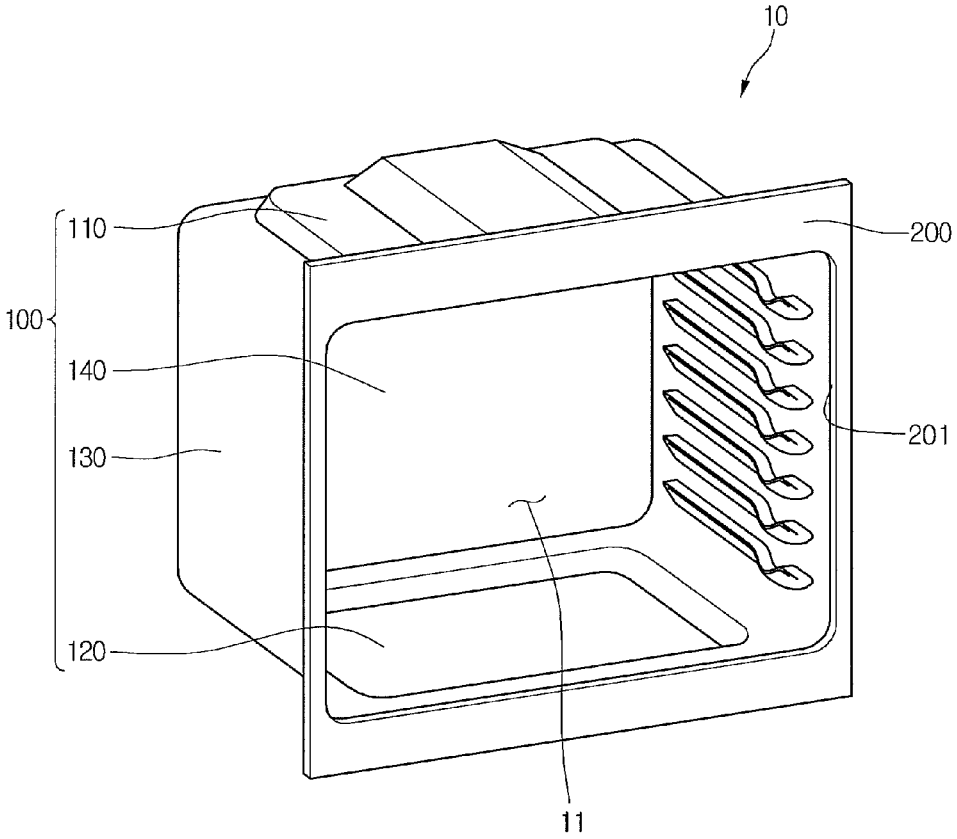
Fig.1 PRIOR ART
FIG. 1 is a perspective view of a cavity assembly according to a related art.
Figure 2:
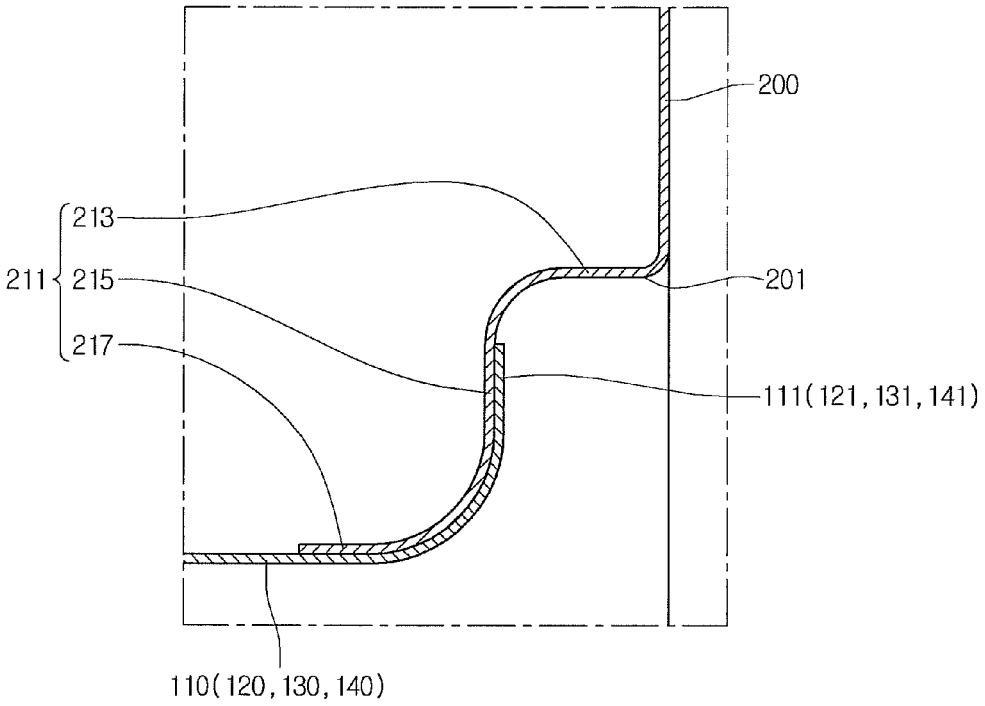
Fig.2 PRIOR ART
FIG. 2 is a cross-sectional view illustrating a main part of the cavity assembly according to the related art.
Figure 3:
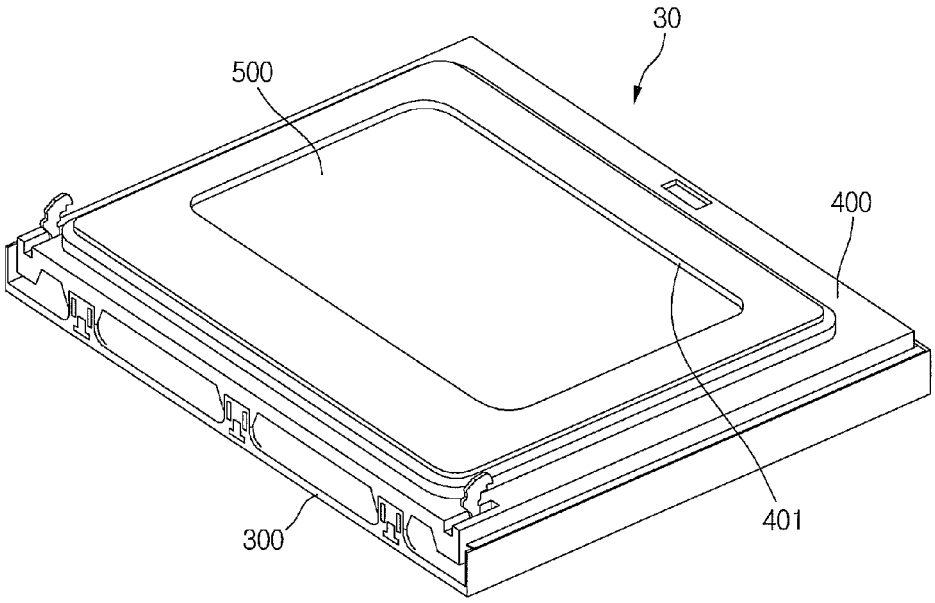
Fig.3 PRIOR ART
FIG. 3 is a perspective view of a door according to the related art.
Figure 6:
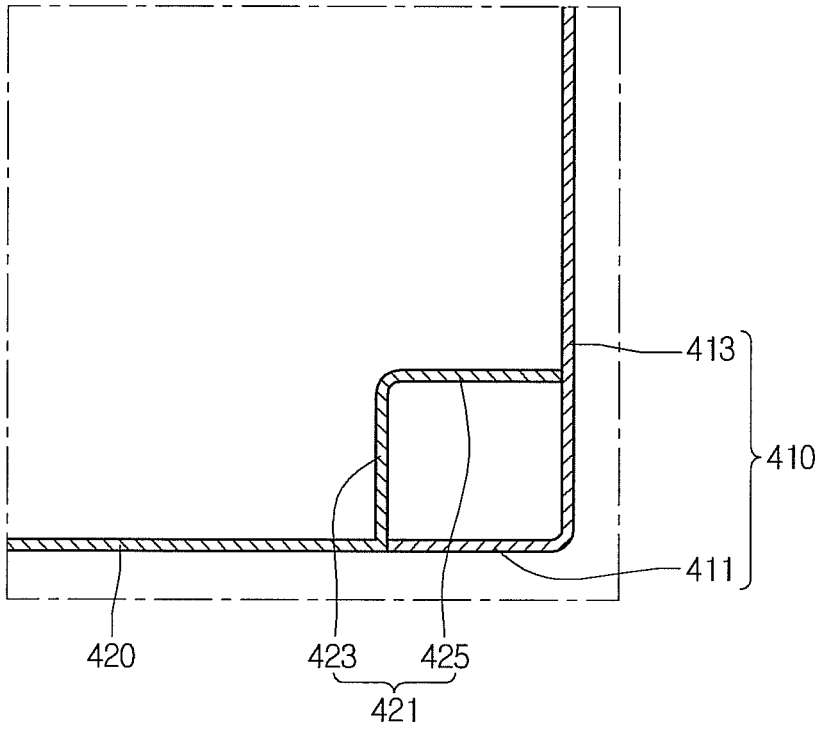
FIG. 6 is a cross-sectional view illustrating a main part of a door according to an embodiment.
Figure 7:
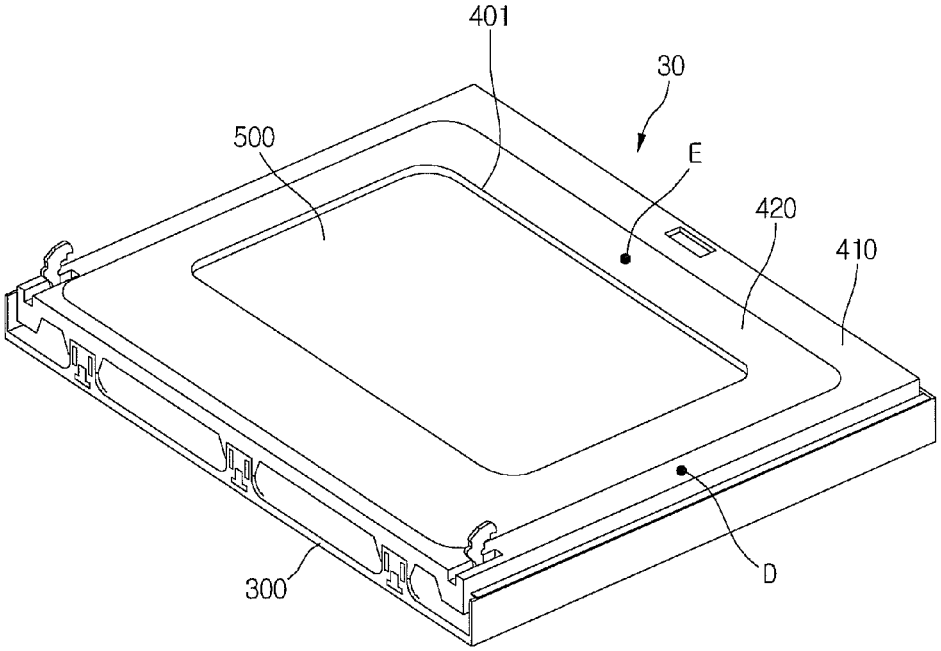
FIG. 7 is a perspective view for comparing a temperature distribution of the door according to an embodiment to that of a door according to the related art.

FIG. 6 is a cross-sectional view illustrating a main part of a door according to an embodiment, and FIG. 7 is a perspective view for comparing a temperature distribution of the door according to an embodiment to that of a door according to the related art. The same component as those according to the related art will be derived from FIG. 3, and thus their detailed descriptions will be omitted.

Referring to FIG. 6, in the current embodiment, the door frame 400 includes a first frame 410 and a second frame 420. The first frame 410 defines an edge of a back surface of the door 30 and an outer appearance of a circumferential surface of the door 30, and the second frame 420 defines an outer appearance of a central portion of the back surface of the door 30.

In detail, the first frame 410 includes a back surface part 411 and a circumferential surface 413. The back surface part 411 may be manufactured as a plate with an approximately central portion opened. The back surface part 411 defines an outer appearance of the edge of the back surface of the door 30. Also, the circumferential surface part 413 extends perpendicular to the back surface part 411 from an outer edge of the back surface part 411. The circumferential surface part 413 defines an outer appearance of the circumferential surface of the door 30.

Also, the second frame 420 is manufactured as a plate having an outer edge that matches the inner edge of the first frame 410, i.e., the inner edge of the back surface part 411. Substantially, the second frame 420 is disposed on the same plane as or a plane parallel to the first frame 410, i.e., the back surface part 411. A rear opening 401 is defined in the second frame 420. The rear opening 410 is defined by cutting a portion of a central portion of the second frame 420. In the current embodiment, a flange part 421 is disposed on an outer edge of the second frame 420. The flange part 421 includes an extension part 423 and a support part 425.

In detail, the extension part 423 is bent approximately perpendicular to the second frame 420 from the outer edge of the second frame 420. Thus, the extension part 423 extends perpendicular to the first frame 410, substantially, the back surface part 411 and extends parallel to the circumferential surface part 413. Here, a front end of the extension part 423 is spaced a preset distance from an inner surface of the back surface part 411. One extension part 423 may be provided on an overall length of the outer edge of the second frame 420.

The support part 425 is bent approximately perpendicular to the extension part 423, i.e., parallel to the second frame 420 from the front end of the extension part 423. Thus, the support part 425 extends parallel to the first frame 410, i.e., the back surface part 411, and extends perpendicular to the circumferential surface part 413. Here, one support member 425 may be provided on an overall length of the front end of the extension part 423, or a plurality of support members 423 may be provided on the front end of the extension part 223 at positions spaced a preset distance from each other.

In the current embodiment, the inner edge of the first frame 410, substantially, the inner edge of the back surface part 411 contacts the flange part 421, substantially, an outer surface of the extension part 423. Thus, the first frame 410 and the flange part 421 may line-contact each other.

Also, the front end of the support part 425 contacts the first frame 410, substantially, the inside of the circumferential surface part 413. As described above, when the support part is provided on the overall length of the front end of the extension part 423, the support part 425 line-contacts the circumferential surface part 413. That is, the flange part 421 line-contacts the first frame 410. Here, the extension part 423 is spaced apart from the circumferential surface part 413, and the support part 425 is spaced apart from the back surface part 411.

When the support part 425 is provided in plurality on the front end of the extension part 423 at positions spaced a preset distance from each other, the support part 425 may have a width relatively less than a thickness thereof. Thus, the support part 425 may point-contact the circumferential surface part 413. That is to say, the flange part 421 point-contacts the first frame 410.

As described above, the first frame 410 is welded to the flange part 421 in a state where the inner edge of the first frame 410 line-contacts the flange part 421. Also, since the flange part 421 line-contacts or point-contacts the first frame 410, the cavity 100 and the front plate 200 may be more firmly supported. As described above, since the first and second frames 410 and 420 are connected to each other through the line-contact and/or the point-contact, a heat transfer rate from first frame 410 substantially contacting the cooking chamber 11 to the second frame 420 may be reduced.

That is, referring to FIG. 7 and Table 2 below, according to the current embodiment, a temperature of the first frame 410 (D) spaced apart from the cooking chamber 11 may decrease when compared to that according to the related art. Also, a temperature of the second frame 420 (E) contacting the cooking chamber 11 may increase when compared to that according to the related art. This represents that leakage of heat within the cooking chamber 11 through the door 30 to the outside in the case according to the current embodiment is relatively reduced when compared to the case according to the related art.

TABLE 2

| | Point D(° C.) | Point E(° C.) |
|---|---|---|
| Related Art | 220 | 380 |
| Embodiment | 176 | 385 |

Figure 8:
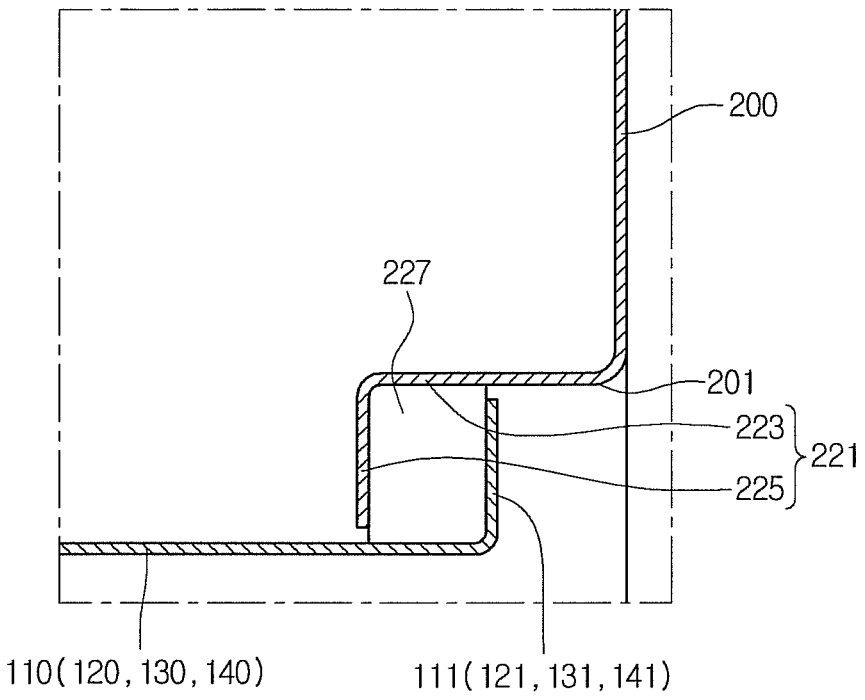
FIG. 8 is a cross-sectional view illustrating a main part of a cavity assembly of a cooking appliance according to another embodiment.

FIG. 8 is a cross-sectional view illustrating a main part of a cavity assembly of a cooking appliance according to another embodiment.

Referring to FIG. 8, in the current embodiment, first flange parts 111, 121, 131, and 141 are disposed on front ends of an upper plate 110, a bottom plate 120, and a pair of side plates 130, respectively. Substantially, since the first flange parts 111, 121, 131, and 141 respectively disposed on the front ends of the upper plate 110, the bottom plate 120, and the pair of side plates 130 have the same function, only the first flange part 111 disposed on the upper plate 110 will be described below.

The first flange part 111 extends perpendicularly from the upper plate 110.

A second flange part 211 is disposed on an inner edge of the front plate 200. The second flange part 211 includes an extension part 223 and a support part 225. Since the second flange part 111 of the front plate 200 is equal to that according to the forgoing embodiment, detailed descriptions thereof will be omitted.

The first flange part 111 and the second flange part 221 are connected to each other by a spacer 227. The spacer 227 may be disposed perpendicular to the first and second flange parts 111 and 221, and then be welded to the first and second flange parts 111 and 221. In this case, the first and second flange parts 111 and 221 do not directly contact each other. The spacer 227 line-contacts each of the first and second flange parts 111 and 221. For another example, an end of the first flange part 111 may line-contact the extension part 223, and an end of the support part 225 may spaced apart from the plates 111, 120, 130, and 140.

For further another example, the support part 425 may not contact a circumferential surface part 413 and be spaced apart from the circumferential surface part 413. In this case, a spacer connecting the support part to the back surface part and disposed to cross the support part 425 and the back surface part 411 may be disposed between the support part 425 and the back surface part 411.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A cooking appliance comprising:

a cavity assembly having a cooking chamber; and a door that selectively opens or closes the cooking chamber, wherein the cavity assembly includes:

a cavity having a plurality of cavity plates defining a top surface, a bottom surface, and both side surfaces of the cooking chamber, wherein a first flange is provided at a front end of each of the plurality of cavity plates; and a front plate having an entrance opening through which food enters into the cooking chamber, the front plate including a second flange, wherein an end of the first flange line-contacts the second flange, and an end of the second flange contacts an outer surface of the cavity.

2. The cooking appliance according to claim 1, wherein the end of the second flange line-contacts or point-contacts the outer surface of the cavity.

3. The cooking appliance according to claim 1, wherein the first flange is bent from the front end of each of the plurality of cavity plates.

4. The cooking appliance according to claim 3, wherein the first flange extends parallel to the front plate.

5. The cooking appliance according to claim 3, wherein the second flange includes:

an extension bent perpendicular to the front plate from an edge of the entrance opening; and at least one support bent perpendicular to the extension from a front end of the extension.

6. The cooking appliance according to claim 5, wherein an end of the extension is spaced apart from the plurality of cavity plates.

7. The cooking appliance according to claim 3, wherein the second flange includes:

an extension bent from an edge of the entrance opening to a rear side of the cavity; and a support bent from the extension toward the inside of the cavity, wherein the support and the first flange are spaced apart from each other.

8. The cooking appliance according to claim 3, wherein the second flange includes:

an extension bent from an edge of the entrance opening and spaced apart from an outer surface of each of the plurality of the cavity plates; and at least one support bent from an end of the extension to line-contact or point-contact the outer surface of the plate.

9. The cooking appliance according to claim 1, wherein the door includes a door frame defining outer appearances of a back surface and a circumferential surface of the door, the door frame having:

a first frame defining an outer appearance of a portion of the back surface of the door; and a second frame provided inside the first frame, the second frame being fixed to the first frame.

10. The cooking appliance according to claim 9, wherein a flange line-contacting an inner edge of the first frame and line-contacting or point-contacting an inner surface of the first frame is provided on the second frame.

11. The cooking appliance according to claim 9, wherein a flange having an extension part bent from an outer edge of the second frame and a support bent from a front end of the extension is provided on the second frame.

12. The cooking appliance according to claim 11, wherein the extension line-contacts an inner edge of the first frame, and the support part line-contacts or point-contacts an inner surface of the first frame.

13. A cooking appliance comprising:

a cavity assembly having a cooking chamber; and a door that selectively opens or closes the cooking chamber, wherein the door includes a door frame defining outer appearances of a back surface and a circumferential surface of the door, the door frame having:

a first frame defining an outer appearance of a portion of the back surface of the door; and a second frame provided inside the first frame, the second frame being fixed to the first frame, wherein a flange line-contacting an inner edge of the first frame is provided on the second frame, and wherein an edge of the first frame contacts the second frame.

14. The cooking appliance according to claim 13, wherein the flange line-contacts or surface-contacts an inner surface of the first frame.

15. The cooking appliance according to claim 14, wherein the flange includes an extension bent from an outer edge of the second frame and a support bent from a front end of the extension, and wherein the support is spaced apart from a front end of the first frame.

16. The cooking appliance according to claim 14, wherein the flange includes an extension bent from an outer edge of the second frame and a support bent from a front end of the extension, and the support is spaced apart from an inner surface of the first frame.

* * * * *